US006303550B1

(12) United States Patent
Wedlock et al.

(10) Patent No.: US 6,303,550 B1
(45) Date of Patent: Oct. 16, 2001

(54) LUBRICATING OIL COMPOSITION

(75) Inventors: David J. Wedlock, Cheshire (GB); Feike de Jong, The Hague (NL)

(73) Assignee: Infineum USA L.P., Linden, NJ (US)

( * ) Notice: Subject to any disclaimer, the term of this patent is extended or adjusted under 35 U.S.C. 154(b) by 0 days.

(21) Appl. No.: 09/432,873

(22) Filed: Nov. 2, 1999

(30) Foreign Application Priority Data

Nov. 6, 1999 (EP) ..... 98309090

(51) Int. Cl.[7] ..... C10M 143/10
(52) U.S. Cl. ..... 508/591; 525/333.3
(58) Field of Search ..... 508/591

(56) References Cited

U.S. PATENT DOCUMENTS

| | | | | |
|---|---|---|---|---|
| 3,231,635 | | 1/1966 | Holden et al. | 260/880 |
| 3,700,633 | | 10/1972 | Wald et al. | 260/880 B |
| 4,036,910 | | 7/1977 | Anderson | 260/879 |
| 4,073,737 | * | 2/1978 | Elliot | 252/51.5 A |
| 4,208,190 | | 6/1980 | Malec | 44/53 |
| 4,764,572 | | 8/1988 | Bean | 526/87 |
| 5,006,608 | * | 4/1991 | Gardiner et al. | 525/370 |
| 5,039,755 | | 8/1991 | Chamberlain et al. | 525/338 |
| 5,194,510 | * | 3/1993 | DuBois | 525/299 |
| 5,194,530 | | 3/1993 | Stevens et al. | 526/82 |
| 5,299,464 | | 4/1994 | Bennett | 73/864.74 |
| 5,543,469 | * | 8/1996 | Struglinski et al. | 525/314 |
| 5,637,783 | * | 6/1997 | Brandes | 585/12 |
| 5,747,433 | * | 5/1998 | Luciani et al. | 508/479 |
| 6,083,888 | * | 7/2000 | Sutherland | 508/221 |

FOREIGN PATENT DOCUMENTS

| | | | |
|---|---|---|---|
| 0 425 027 A2 | 5/1991 | (EP) | C08F/297/04 |
| 0 653 453 A1 | 5/1993 | (EP) | C08G/81/02 |
| 0 540 109 B1 | 5/1997 | (EP) | C08G/81/02 |
| 0 819 755 A2 | 1/1998 | (EP) | C10M/143/10 |
| 0 653 449 B1 | 9/1998 | (EP) | C08F/297/04 |
| 1205594 | 9/1970 | (GB) . | |

OTHER PUBLICATIONS

"Lubricating Oils for Internal Combustion Engines", Research Disclosure, No. 386, Jun. 1, 1996 pp. 395–396, (XP–000596192).

Proceedings of Conference "Viscosity and Flow Properties of Multigrade Engine Oils" Esslingen, Germany, Dec. 1977 (Book will be furnished upon request).

* cited by examiner

*Primary Examiner*—Ellen M. McAvoy

(57) ABSTRACT

A lubricating oil composition comprising a di-block copolymer of poly(monovinyl aromatic hydrocarbon) and hydrogenated poly(conjugated diene) as a dispersant additive is described. The said di-block copolymer preferably comprises poly(monovinyl aromatic hydrocarbon) in the molecular weight range 8,000–30,000. The diblock copolymers are useful as dispersant additives in lubricant oils, reduce heavy metal corrosion, reduce degradation of elastomeric seals and are less sensitive to the presence of over-based detergents.

20 Claims, 7 Drawing Sheets

26 m.mol/kg Ac NS 60/115. Response as a function of dispersant (SAP-285/SAP-230TP) and VII

LUBRICATING OIL COMPOSITION

The present invention relates to lubricating oil compositions, in particular, lubricating oil compositions having di-block copolymers of poly(monovinyl aromatic hydrocarbon) and poly(conjugated diene) as dispersants.

High molecular weight oil-soluble di-block copolymers can be used for improving the effective viscosity index (VI) of lubricating oil formulations. The VI is a measure of the tendency of a fully formulated oil to resist decrease in viscosity with increasing temperature. The higher the viscosity index—the more the fully formulated oil can resist viscosity decrease with increasing temperature. Base oils have an inherent VI but this is normally not adequate for all engine operational needs.

Specifically synthesised ashless dispersants are added to fully formulated crankcase lubricant oils to keep combustion-derived soots and oxidation-derived sludges in dispersion. Generally, these are surface active molecules of 2000 to 6000 Daltons molecular weight. For example, polyisobutylene (PIB) is chemically linked to maleic anhydride (MALA) to give a covalently bonded compound PIBMALA. This may then be reacted with a variety of polyamines or polyalcohols to give a range of molecules; PIBMALA amines and PIBMALA esters. Typically the PIB will be in the molecular weight range 1000 to 3000 Dalton, and the polyamine will be diethylene triamine (DETA), triethylene tetramine (TETA) or higher polyamine homologues. These molecules are surface active and can maintain in a stable colloid state, soots and sludges in a crankcase lubricating oil.

Certain oil-soluble polymers can effectively increase the viscosity of a lubricant oil formulation at higher temperatures (typically above 100° C.) while not excessively increasing high shear rate viscosity at lower temperatures (typically −10 to −15° C). These oil-soluble polymers are generally relatively high molecular weight (>100,000 Dalton) compared to base oil and additive components. They may be polymers such as OCPs (olefin copolymers), star polymers, or association di-block copolymers, generally handled for convenience as a dissolved technical concentrate in base oil carrier. It is known that such di-block copolymers associate or aggregate to form micelles in order to reduce exposure of the insoluble chain section to the base oil. This assists their thickening tendency over a limited temperature range.

Di-block copolymers may act as colloid (small particle) stabilisers or dispersants in solid-in-oil dispersions, when one block of the chain is capable of adsorbing to a particulate substrate and when the other block is readily soluble in the liquid oil-continuous phase. Such di-block copolymers can function as both dispersants with respect to soot and sludge, and viscosity index improvers (VIIs).

Figure 1:
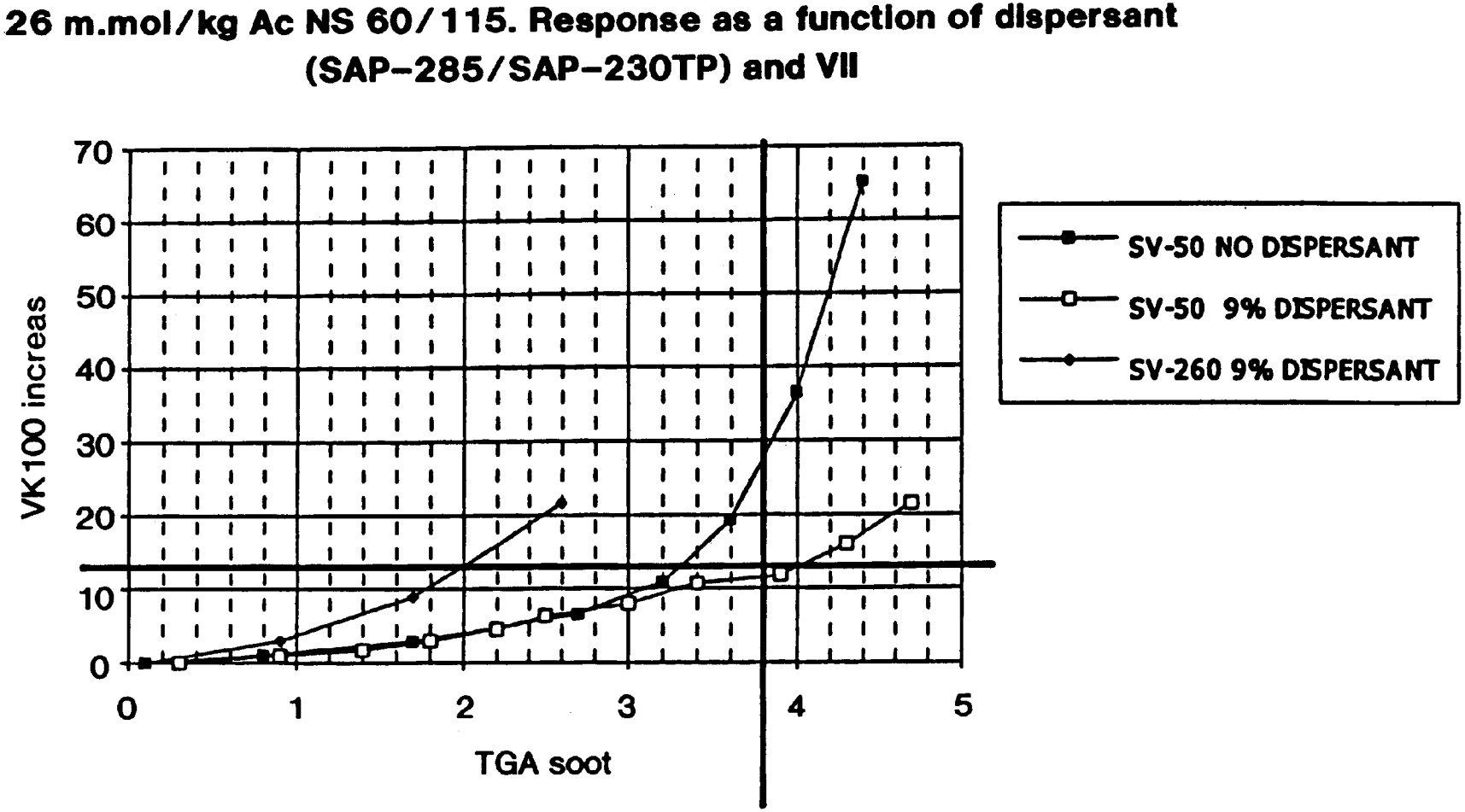
FIG. 1 graphically plots kinematic viscosity response of a lubricant as a function of dispersant and VII content.

Among the groups of polynmers which can give this VI credit to fully formulated internal combustion engine lubricant oils (gasoline and diesel type) are di-block copolymers of polystyrene (PS) and hydrogenated polyisoprene (HPIP). The polystyrene units are not soluble in the base oil, the hydrogenated polyisoprene is and the polymers are synthesised to give a net balance of base oil solubility. For instance, VII's comprising PS/BHPIP diblock copolymers of high molecular weight can cause improved dispersancy as compared with HPIP star polymer VII alone (FIG. 1). However, it is understood that di-block copolymers cannot function as dispersants as well as functioning as VIIs at lower molecular weight because the micellisation is expected to be overly compact and this would compromise dispersancy and their thickening tendency over a limited temperature range. Furthermore, the polystyrene chain length is expected to be too short to achieve absorption/stability in relation to soots and sludges.

Known formulations of high molecular weight di-block copolymers of polystyrene and hydrogenated polyisoprene have shown that for dispersions of a carbon black (Vulcan XC72R, Cabot) in a base oil of lubricating quality, the viscosity of the dispersion at a given shear rate or shear stress is lower for the oil containing the polystyrene-hydrogenated polyisoprene di-block copolymers of total molecular weight 100,000 or 135,000 respectively. The styrene/isoprene ratio required is normally such as to confer base oil solubility of the di-block copolymer but is typically 35,000 (polystyrene)+65,000 (hydrogenated polyisoprene) in the case of the 100,000 molecular weight di-block, and 50,000 (polystyrene)+85,000 (hydrogenated polyisoprene) in the case of the 135,000 molecular weight di-block. In either case, for good solubility a high hydrogenated polyisoprene: polystyrene ratio of at least 3:2 is expected to give good results.

This beneficial dispersion behaviour is seen for fully formulated diesel engine lubricants containing such di-block VIIs in specification diesel engine tests such as the Mack T8 test within the API (American Petroleum Institute) CG4 performance category. This test measures soot-induced thickening of the oil during engine use. This dispersant behaviour of polystyrene-hydrogenated polyisoprene di-block copolymers manifests itself as beneficial performance in a range of crankcase lubricant specification engine tests, typically reducing soot-induced thickening of diesel engine lubricants and enhancing engine cleanliness by acting as a sludge and soot dispersant in diesel and gasoline engine lubricants. However, such relatively high molecular weight dispersant additives are incompatible with most additive packages.

Corrosion and degradation of parts is a significant problem in lubrication technology. Succinimide dispersants are known to cause some corrosion of heavy metal bearings for instance, copper and lead components, and, similarly, degrade elastomeric seals. Much research has gone into reducing corrosion levels for heavy metals and degradation rates for elastomeric seals.

Succinimide dispersants are also known to have reduced effectiveness in the presence of over-based detergents.

According to the present invention there is provided a lubricating oil composition comprising a di-block copolymer of poly(monovinyl aromatic hydrocarbon) and poly (conjugated diene) as a dispersant additive, the said di-block copolymer comprising poly(monovinyl aromatic hydrocarbon) in the molecular weight range 8,000–30,000.

Preferably, the molecular weight range of the poly (monovinyl aromatic hydrocarbon) is in the range 8,400–25, 000. Most preferably, the poly(monovinyl aromatic hydrocarbon) molecular weight range is between 8,400 and 20,000.

According to the second aspect of the present invention there is provided a lubricating oil composition comprising a di-block copolymer of poly(monovinyl aromatic hydrocarbon) and poly(conjugated diene) as dispersant, the poly(monovinyl aromatic hydrocarbon): poly(conjugated diene) molecular weight ratio being in the range from 0.2:1 to 10:1.

Preferably, the poly(monovinyl aromatic hydrocarbon) :poly(conjugated diene) ratio is in the range 3:2 to 10:1. More preferably, the poly(monovinyl aromatic hydrocarbon):poly(conjugated diene) ratio is in the range of 3:2 to 5:1.

Preferably, the percentage of poly(monovinyl aromatic hydrocarbon) in the poly(monovinyl aromatic hydrocarbon)/ poly(conjugated diene) di-block copolymer is at least 60% w/w, more preferably between 60% and 90% w/w, most preferably between 60% and 85% w/w. Preferred monovinyl aromatic hydrocarbon monomers for use in preparing the poly(monovinyl aromatic hydrocarbon) blocks for use in the present invention include styrene, alkyl-substituted styrene, and alkoxy- substituted styrene, vinyl naphthalene, and alkyl-substituted vinyl naphthalene. The alkyl and alkoxy substituents may typically comprise from 1 to 6 carbon atoms, preferably from 1 to 4 carbon atoms. The number of alkyl or alkoxy substituents per molecule, if present, may range from 1 to 3, and is preferably one.

Preferred conjugated diene monomers for use in preparing the poly(conjugated diene) block for use in the present invention include those conjugated dienes containing from 4 to 24 carbon atoms such as 1,3-butadiene, isoprene, piperylene, methylpentadiene, 2-phenyl-1,3-butadiene, 3,4-dimethyl-1,3-hexadiene, and 4,5-diethyl- 1,3-octadiene.

Preferably, the block copolymer(s) in accordance with the present invention comprise(s) at least one poly (monovinylaromatic hydrocarbon) block and at least one poly(conjugated diene) block. Preferred block copolymers are selected from the group consisting of those of the formulae $A_n(BA)_m$, wherein A represents a block polymer of predominantly poly(monovinyl aromatic hydrocarbon), wherein B represents a block of predominantly poly (conjugated diene), wherein m represents an integer$\geqq$1, preferably 1 to 8, more preferably 1 to 4, in particular 1, and represents 0 or 1.

Preferably, the poly(conjugated diene) block is hydrogenated.

More preferably, the monovinyl aromatic hydrocarbons are styrene and/or alkyl-substituted styrene, in particular styrene.

Preferred conjugated dienes are those containing from 4 to 12 carbon atoms, more preferably from 4 to 6 carbon atoms. Isoprene and butadiene are the most preferred conjugated diene monomers for use in the present invention because of their low cost and ready availability.

More preferably, the A blocks represent predorninantly poly(styrene) blocks and the B blocks represent predominantly poly(butadiene) blocks, predominantly poly (isoprene) blocks or isoprene/butadiene copolymer blocks.

Preferably, the poly(isoprene) is hydrogenated.

With the term "predominantly" in relation to block A is meant that the said block is mainly derived from a monovinylaromatic hydrocarbon monomer (eg styrene) and up to 20% by weight of another monovinylaromatic hydrocarbon monomer (eg a-methylstyrene), preferably up to 10% by weight; or up to 10% by weight of a conjugated diene monomer (eg butadiene andlor isoprene), preferably up to 5% by weight.

With the term "predominantly" in relation to block B is meant that the said block is mainly derived from a conjugated diene monomer or a mixture of two or more, preferably two, conjugated diene monomers and up to 10% by weight of a monovinylaromatic hydrocarbon monomer, preferably up to 5% by weight Multivalent coupling agents may be used and include those commonly known in the art.

Examples of suitable multivalent coupling agents contain from 2 to 8, preferably 2 to 6, more preferably 2, 3 or 4 functional groups.

More preferably, the block copolymers contain pure poly (styrene), and pure hydrogenated poly(isoprene) blocks.

Block copolymers and selectively hydrogenated block copolymers comprising at least one poly (monovinylaromatic hydrocarbon) block and at least one poly(conjugated diene) block, are well known in the art and available cormercially.

The block copolymers can be made by anionic polymerisation with an alkali metal initiator such as sec-butyllithium as disclosed for instance in U.S. Pat. Nos. 4,764,572, 3,231, 635, 3,700,633, and 5,194,530.

The poly(conjugated diene) block(s) of the block copolymer may be selectively hydrogenated, typically a residual ethylenic unsaturation of at most 20%, more preferably at most 5%, and most preferably at most 2% of its original unsaturation content prior to hydrogenation. Preferably, the block copolymers to be used in the compositions according to the invention are selectively hydrogenated. Hydrogenation may be effected selectively as disclosed in U.S Patent Reissue 27,145. The hydrogenation of these polymers and copolymers may be carried out by a variety of well established processes including hydrogenation in the presence of such catalysts as Raney Nickel, noble metals such as platinum and the like, soluble transition metal catalysts and titanium catalysts as in U.S. Pat. No. 5,039,755. The polymers may have different diene blocks and these diene blocks may be selectively hydrogenated as described in U.S. Pat. No. 5,299,464. As set out above, the ethylenic unsaturation in the block copolymers may be removed by selective hydrogenation. In addition, it is also possible to selectively remove the ethylenic unsaturation in some arms whilst leaving the ethylenic unsaturation in other anns intact as disclosed for example in EP 0540109, 0653453 and 0653449.

The vinyl content of (hydrogenated) poly(isoprene) block (s) may vary within wide limits and is typically in the range from 0 to 75% mol, preferably 0 to 20% mol.

Advantageously, such dispersant additives have little deleterious effect on heavy metal bearing corrosion and seal elastomers compared to PIBMALA amines and, more importantly, have dispersancy largely independent of detergent soap levels unlike succinimides. Furthermore, surprisingly, the lower molecular weight di block copolymers form micellar structures in base oil which dissociate above certain temperatures.

The present invention preferably provides a lubricating oil composition comprising a major amount (more than 50% w) of a lubricating base oil and a minor amount (less than 50% w), preferably from 0.1 to 20% w, especially from 0.5 to 10% w (active matter), of the di-block copolymer according to the present invention, the percentages by weight being based on the total weight of the composition.

A lubricant formulation may be produced by addition of an additive package to the lubricating oil. A minor amount of viscosity modifier may be included if the final lubricant formulation is to be a multigrade version. The type and amount of additive package used in the formulation depends on the final application, which can include spark-ignition and compression-ignition internal combustion engines, including automobile and truck engines, marine and railroad diesel engines, gas engines, stationary power engines and turbines.

The lubricant formulation is blended to meet a series of performance specifications as classified in the US by a tripartite arrangement between the Society of Automotive Engineers (SAE), American Petroleum Institute (API) and American Society for Testing and Materials (ASTM). Also the American Automobile Manufacturers Association (AAMA) and Japan Automobile Manufacturers Association Inc. (JAMA), via an organisation called the International Lubricant Standardisation and Approval Committee (ILSAC), jointly develop minimum performance standards for gasoline-fuelled passenger car engine oils.

In Europe, engine oil classifications are set by the Association des Constructeurs Europeens de l' Automobile (ACEA) in consultation with the Technical Committee of Petroleum Additive Manufacturers (ATC) and Association Technique de l' Industries Europeens des Lubrifants (ATIEL). Besides these internationally recognised oil classification systems, many, if not all, Original Equipment Manufacturers (OEMs) have their own in-house performance requirements that must be met by lubricant formulations used for first (i.e. factory) fill.

Suitable lubricating base oils are natural, mineral or synthetic lubricating oils.

Natural lubricating oils include animal and vegetable oils, such as castor oil. Mineral oils comprise the lubricating oil fractions derived from crude oils, e.g. of the naphthenic or paraffinic types or mixtures thereof, coal or shale, which fractions may have been subjected to certain treatments such as clay-acid, solvent or hydrogenation treatments. Synthetic lubricating oils include synthetic polymers of hydrocarbons, e.g. derived from polyalphaolefins, isomerised slack wax, modified alkylene oxide polymers and esters, which are known in the art. These lubricating oils are preferably crankcase lubricating oil formulations for spark-ignition and compression-ignition engines, but include also hydraulic lubricants, metal-working fluids and automatic transmission fluids.

Preferably the lubricating base oil component of the compositions according to the present invention is a mineral lubricating oil or a mixture of mineral lubricating oils, such as those sold by member companies of the Royal Dutch/Shell Group of Companies under the designations "HVI", or the synthetic hydrocarbon base oils sold by member companies of the Royal Dutch/Shell Group of Companies under the designation "XHVI" (trade mark).

The viscosity of the lubricating base oils present in the compositions according to the present invention may vary within wide ranges, and is generally from 3 to 35 $mm^2/s$ at 100° C.

The lubricating oil compositions according to the present invention may contain various other additives known in the art, such as:

(a) Viscosity index improvers or modifiers. The viscosity modifier may be of the solid type or a concentrate in a natural or synthetic base stock and can be defmed as a substance, usually a polymer, which substantially improves (e.g. by at least 5 units) the viscosity index (e.g. as determined by ASTM procedure D2270) by its incorporation. These can all be incorporated into the final lubricant formulation to give the desired performance properties thereof. Examples of such viscosity modifiers are linear or star-shaped polymers of a diene such as isoprene or butadiene, or a copolymer of such a diene with optionally substituted styrene. These copolymers are suitably block copolymers and are preferably hydrogenated to such an extent as to saturate most of the olefinic unsaturation. A number of other types of viscosity modifier are known in the art, and many of these are described in Proceedings of Conference "Viscosity and flow properties of multigrade engine oils", Esslingen, Germany, December 1977. It is also known in the art that viscosity modifiers can be functionalised to incorporate dispersancy (e.g. dispersant viscosity index improvers based on block copolymers, or polymethacrylates) and/or antioxidant functionality as well as viscosity modification and they can also have pour point depressants mixed in to give handleable products in cold climates.

(b) Ashless or ash-containing extreme pressure/anti-wear additives, such as, for example, those of the metal containing dithiophosphate or ashless dithiocarbamate type, and mixtures thereof. The actual composition of the individual components will vary depending upon final application and hence can be based on a range of metal ion types and various alcohols, in which both alkyl and aryl moieties may be of varying size. Preferred are zinc dithiophosphates (ZDTPs) or sodium dithiophosphates.

(c) Dispersants including succinimides and Mannich bases, both of various molecular weights and amine type, including borated versions, or esters also of varying type and molecular weight. Preferred are ashless dispersants such as polyolefin-substituted succinimides, e.g. those described in GB-A-2231873.

(d) Anti-oxidants, for example of the aminic type such as "IRGANOX" (trade mark) L57 (tertiary $C_4$–$C_{12}$ alkyl diphenylamine) or phenolic type such as "IRGANOX" (trade mark) L135 (2,6-ditertiary-butyl4-(2-carboxy (alkyl)ethyl)phenol) (ex. CIBA Speciality Chemicals) or a soluble copper compound at a copper concentration of between 50 and 500 ppm.

(e) Anti-rust compounds of, for example, the ethylene/propylene block copolymer type.

(f) Friction modifiers for fuel economy, either metal (e.g. molybdenum) containing, or metal free esters and amines, or synergistic mixtures thereof.

(g) Metal containing detergents such as phenates, sulphonates, salicylates or naphthenates, or mixtures thereof, all of which detergents may be either neutral or overbased, such overbased detergents being carbonates, hydroxides or mixtures thereof. The metals are preferably calcium, magnesium or manganese, although alkali metals such as sodium or potassium could also be used.

(h) Copper passivators, preferably of the alkylated or benzylated triazole type.

The di-block copolymer of the present invention may also be used in fuels. Accordingly, the present invention further provides a fuel composition comprising a major amount (more than 50% w) of a base fuel and a minor amount (less than 50% w), preferably from 0.001 to 2% w, more preferably from 0.001 to 0.5% w and especially from 0.002 to 0.2% w (active matter), of a di-block copolymer according to the present invention, the percentages by weight being based on the total weight of the composition.

Suitable base fuels include gasoline and diesel fuel. These base fuels may comprise mixtures of saturated, olefinic and aromatic hydrocarbons, and may contain a range of sulphur levels, e.g. in the range 0.001 to 0.% w. They can be derived from straight-run gasoline, synthetically produced aromatic hydrocarbon mixtures, thermally catalytically cracked hydrocarbon feedstocks, hydrocracked petroleum fractions or catalytically reformed hydrocarbons.

The fuel compositions according to the present invention may contain various other additives known in the art, such as:

(a) Anti-knock additives, such as lead compounds, or other compounds such as methyl cyclopentadienyl-manganese tricarbonyl or orthoazidophenyl.

(b) Co-antiknock additives, such as benzoylacetone.

(c) Dehazers, such as those commercially available as "NALCO" (trade mark) EC5462A (ex. Nalco), "TOLAD" (trade mark) 2683 (ex. Baker Petrolite), EXP177, EXPI59M, EXP175, EP409 or EP435 (ex. RE Speciality Chemicals), and T9360-K, T9305, T9308, T93 11 or T327 (ex. Baker Petrolite).

(d) Anti-foaming agents, such as those commercially available as "TEGOPREN" (trade mark) 5851, Q 25907, MR1027, MR2068 or MR2057 (ex. Dow Coming), "RHODORSIL" (trade mark) (ex. Rhone Poulenc), and "WITCO" (trade mark) SAG TP325 or SAG327 (ex. Witco).

(e) Ignition improvers (e.g. 2-ethylhexyl nitrate, cyclohexyl nitrate, di-tertiary-butyl peroxide and those disclosed in U.S. Pat. No. 4208190 at Column 2, line 27 to Column 3, line 21)

(f) Anti-rust agents (e.g. that commercially sold by Rhein Chemie, Mannheim, Germany as "RC 4801", or polyhydric alcohol esters of a succinic acid derivative, the succinic acid derivative having on at least one of its alpha carbon atoms an unsubstituted or substituted aliphatic hydrocarbon group containing from 20 to 500 carbon atoms (e.g. the pentaerythritol diester of polyisobutylene-substituted succinic acid)

(g) Reodorants.

(h) Anti-wear additives.

(i) Anti-oxidants (e.g. phenolics such as 2,6-di-tert-butylphenol, or phenylenediamines such as N,N'-di-sec-butyl-p-phenylenediamine).

(j) Metal deactivators.

(k) Lubricity agents, such as those commercially available as EC831, "PARADYNE" (trade mark) 631 or 655 (ex. Paramins) or "VEKTRON" (trade mark) 6010 (ex. Shell Additives International Limited).

(l) Carrier fluids such as a polyether e.g. a $C_{12}$–$C_{15}$ alkyl-substituted propylene glycol ("SAP 949"), "HVI" or "XHVI" (trade mark) base oil, which are commercially available from member companies of the Royal Dutch/Shell Group of Companies, a polyolefin derived from $C_2$–$C_6$ monomers, e.g. polyisobutylene having from 20 to 175, particularly 35 to 150, carbon atoms, or a polyalphaolefin having a viscosity at 100° C. in the range $2\times10^{-4}$ to $2\times10^{-5}$ $m^2/s$ (2 to 20 centistokes), being a hydrogenated oligomer containing 18 to 80 carbon atoms derived from at least one alphaolefinic monomer containing from 8 to 18 carbon atoms.

The lubricating oil and fuel compositions of the present invention may be prepared by adding the di-block copolymer of the present invention to a lubricating base oil or base fuel. Conveniently, an additive concentrate is blended with the lubricating base oil or base fuel. Such a concentrate generally comprises an inert carrier fluid and one or more additives in a concentrated form. Hence the present invention also provides an additive concentrate comprising an inert carrier fluid and from 10 to 80% w (active matter) of the di-block copolymer according to the present invention, the percentages by weight being based on the total weight of the concentrate.

Examples of inert carrier fluids include hydrocarbons and mixtures of hydrocarbons with alcohols or ethers, such as methanol, ethanol, propanol, 2-butoxyethanol or methyl tert-butyl ether. For example, the carrier fluid may be an aromatic hydrocarbon solvent such as toluene, xylene, mixtures thereof or mixtures of toluene or xylene with an alcohol. Alternatively, the carrier fluid may be a mineral base oil or mixture of mineral base oils, such as those sold by member companies of the Royal Dutch/Shell Group of Companies under the designations "HVI", e.g. "HVI 60" base oil, or the synthetic hydrocarbon base oils sold by member companies of the Royal Dutch/Shell Group of Companies under the designation "XHVI" (trade mark).

Non-limiting examples of suitable additive concentrations in final blended lubricating oil compositions are:

| Oil component % mass | A | B | C | D | E | F |
|---|---|---|---|---|---|---|
| Alkaline earth sulphonate detergent | 3.8 | 3.4 | — | — | — | — |
| Alkaline earth phenate detergent | 1.2 | 1.1 | — | — | — | — |
| Alkaline earth salicylate detergent | — | — | 4.6 | 2.5 | 3.6 | 10.5 |
| High molecular weight dispersant | — | 5.5 | 8.0 | 5.0 | 11.5 | — |
| Low molecular weight dispersant | 6.0 | 2.0 | — | — | — | 9.0 |
| Primary ZDTP | 0.5 | — | — | 0.3 | — | 0.7 |
| Secondary ZDTP | 0.4 | 1.0 | 0.9 | 0.7 | 1.2 | 0.6 |
| Aminic antioxidant | — | — | 0.6 | 0.8 | 0.3 | — |
| Phenolic antioxidant | 0.7 | 1.2 | — | — | — | — |
| Base oil | balance | balance | balance | balance | balance | balance |

Non-limiting examples of suitable additive concentrates for blending lubricating oil compositions are:

| Oil component % mass | A | B | C | D | E | F |
|---|---|---|---|---|---|---|
| Alkaline earth sulphonate detergent | 29.9 | 23.8 | — | — | — | — |
| Alkaline earth phenate detergent | 9.4 | 7.7 | — | — | — | — |
| Alkaline earth salicylate detergent | — | — | 32.4 | 26.6 | 21.6 | 50.2 |

-continued

| | | | | | | |
|---|---|---|---|---|---|---|
| High molecular weight dispersant | — | 38.5 | 56.3 | 53.2 | 68.9 | — |
| Low molecular weight dispersant | 47.2 | 14.0 | — | — | — | 43.1 |
| Primary ZDTP | 3.9 | — | — | 3.2 | — | 3.3 |
| Secondary ZDTP | 3.1 | 7.0 | 6.3 | 7.4 | 7.2 | 2.9 |
| Aminic antioxidant | — | — | 4.2 | 8.5 | 1.8 | — |
| Phenolic antioxidant | 5.5 | 8.4 | — | — | — | — |
| Base oil | balance | balance | balance | balance | balance | balance |

The present invention still further provides the use of a di-block copolymer according to the present invention as a dispersant additive.

The invention will now be described with reference to the accompanying examples.

The preparations were living polymer anionic polymerisations with sequential addition of monomer using butyl lithium as the anion initiator, at ~50° C. Hydrogenations were performed using Pd on carbon catalyst (Degussa450) at ~130° C.

Examples of di-block copolymers synthesised and evaluated

| | PS (Mn) Molecular weight | HPIP (Mn) Molecular weight | Total Molecular weight | % PS |
|---|---|---|---|---|
| Example 1 | 561 | 755 | 1316 | 43 |
| Example 2 | 867 | 970 | 1837 | 47 |
| Example 3 | 1032 | 1536 | 2568 | 40 |
| Example 4 | 2519 | 4481 | 7000 | 36 |
| Example 5 | 4970 | 4517 | 9487 | 52 |
| Example 6 | 8400 | 5600 | 14000 | 60 |
| Example 7 | 17380 | 4620 | 22000 | 79 |
| Example 8 | 35000 | 65000 | 100000 | 35 |
| Example 9 | ~48000 | 105000 | 153000 | 31 |

Dispersancy

Dispersant samples were assessed Theologically in a variable shear rate rheorneter as carbon black dispersions (5% w/w Vulcan XC72R, Cabot), in either base oil solution or in a fully formulated screener oil at 100° C.

The samples were assessed first for carbon black (CB) dispersancy as solutions in Type A base stock at 0.5% active matter (a.m.), since this was felt to be likely to give the best possible chance of demonstrating a dispersancy lift. In essence only Example 7 showed a significant dispersancy lift and in fact the Example 1, with the lowest total molecular weight, appeared to thicken the carbon black dispersion, see FIGS. 2 and 3.

For examples 5–7 the PS chain was synthesised to a higher molecular weight than the HPIP chain, for an essentially constant BPIP mol. weight. Only a slight dispersancy performance at 8400 MW in Type A base stocks was observed until the molecular weight of PS was shifted from 8A to 17.5K dalton (Example 7)—for the HPIP held in the range 4 to 5 K dalton.

Figure 2:
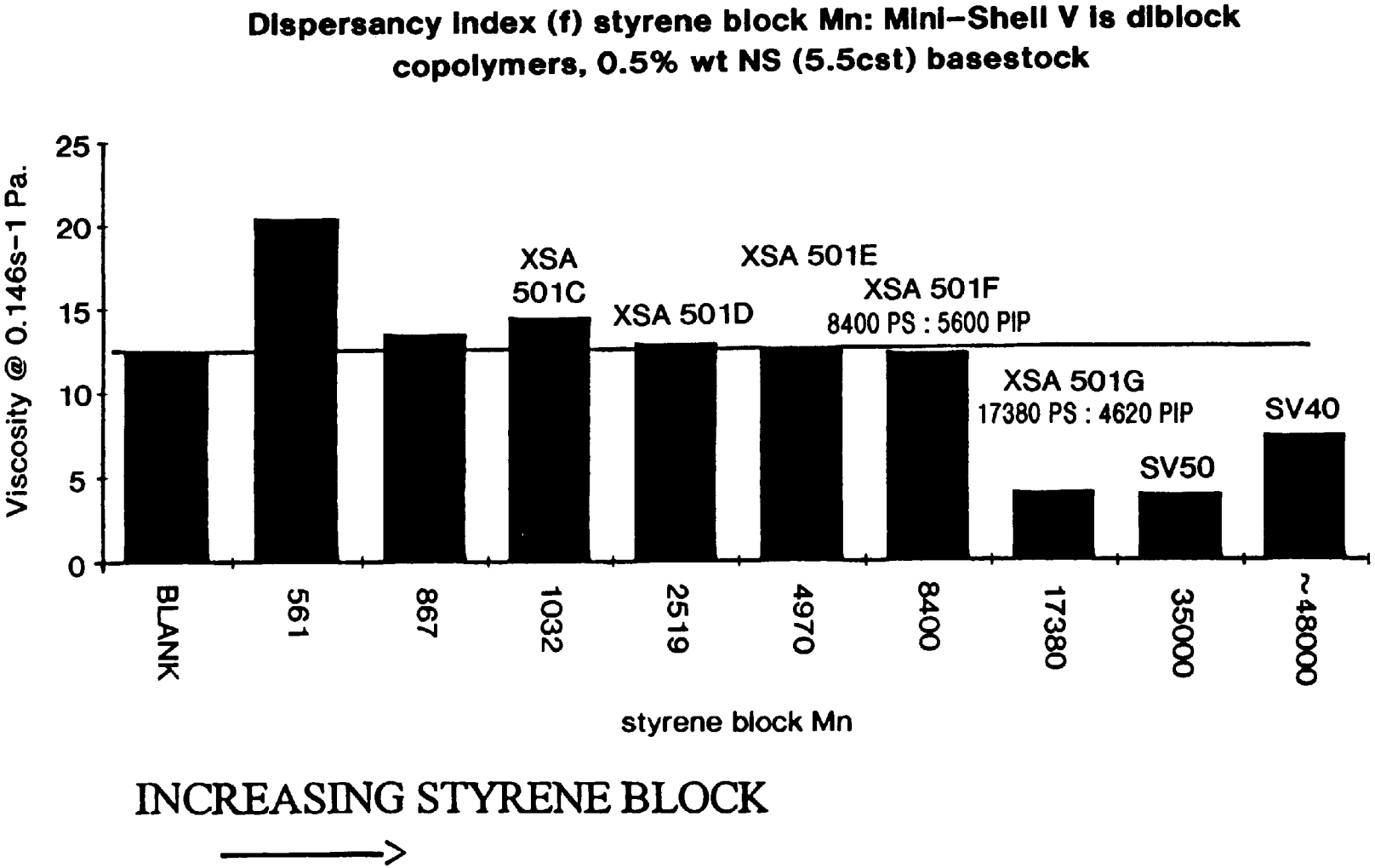
FIG. 2 illustrates the dispersity index of specified diblock copolymers in a Type A (5.5 cst) basestock.
Figure 3:
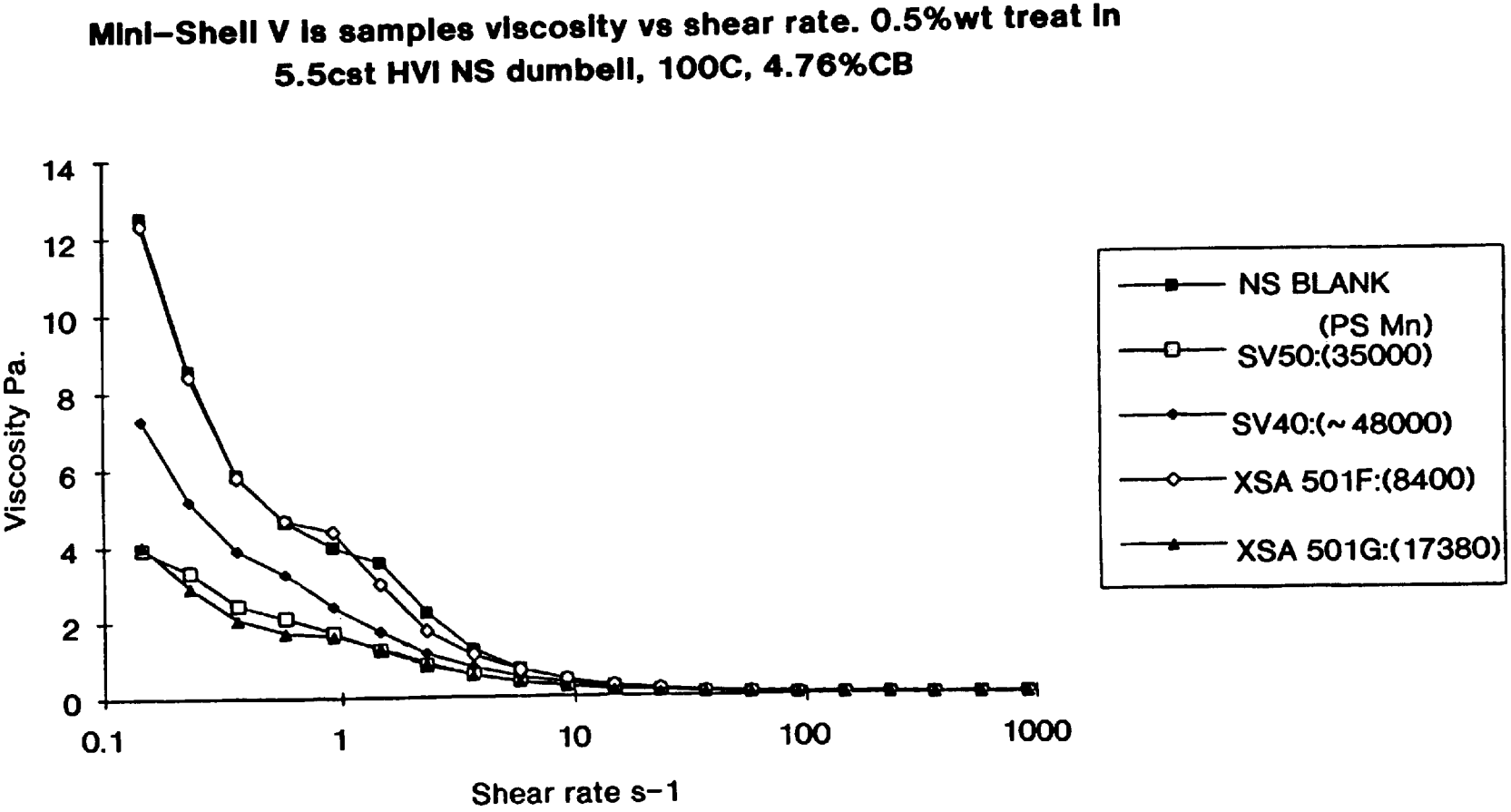
FIG. 3 compares viscosity to shear rate for specified diblock copolymers in a Type A (5.5 cst) basestock.

Since the transition in behaviour from non-dispersant to dispersant for Example 5 through to 7 demonstrates clearly a critical chain length of PS required, this may suggest a 'statistical' adsorption process where the adsorption energy per monomer unit is weak but multi-point attachment ensures no desorption once attachment has occurred ie a typical 'homopolymer' adsorption process. In FIG. 2, the complete rheogram shows that Example 7 is probably directionally stronger as a dispersant than Example 8 at the same active matter level. This same effect is shown in FIG. 3, which plots kinematic viscosity vs shear rate.

Figure 4:
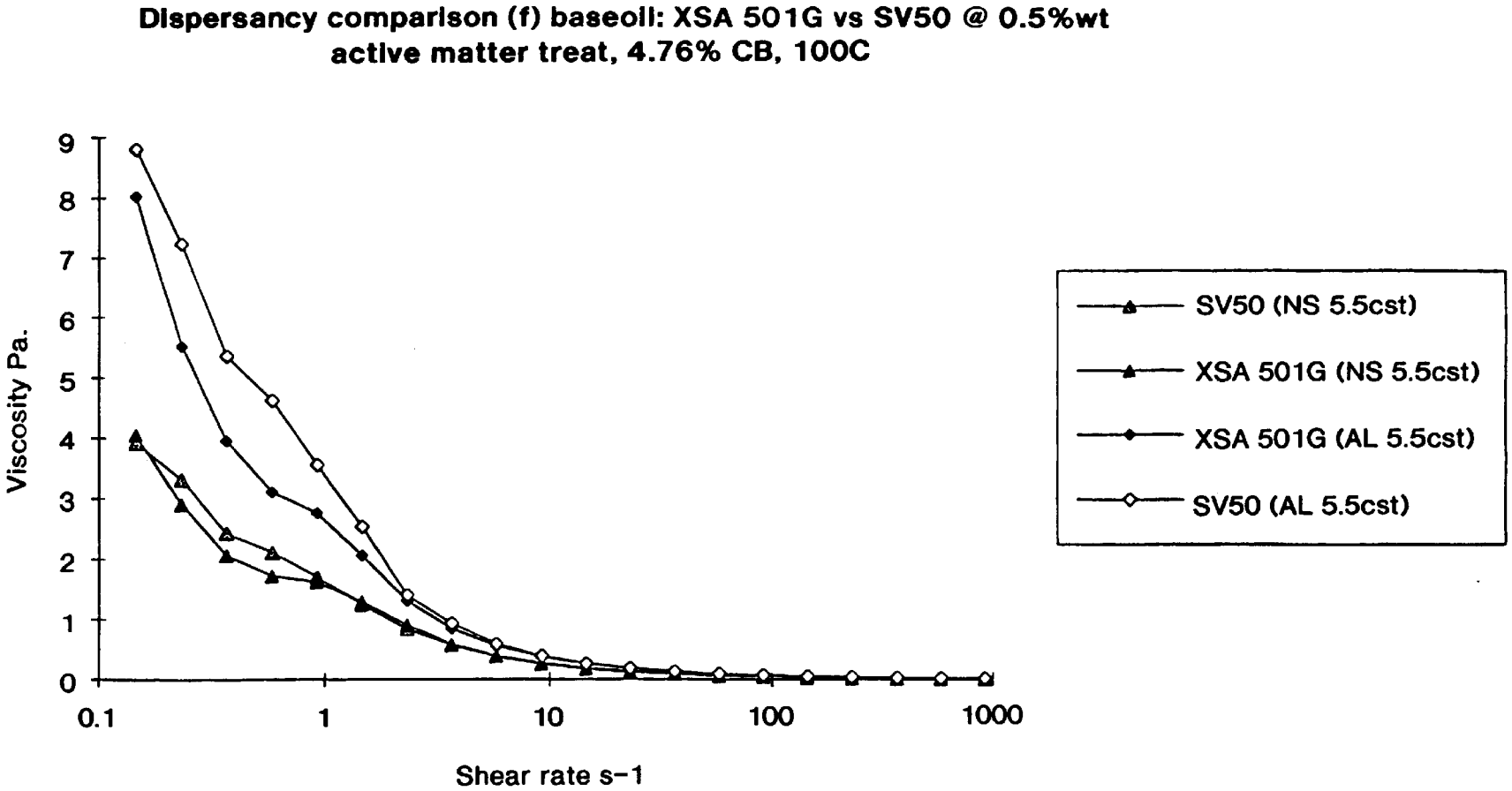
FIG. 4 compares the dispersing properties of diblock copolymers of Examples 7 and 8 in a base oil.

Example 7 was also assessed in the more aromatic Type B base oil to see if similar base oil sensitivity to dispersancy performance, as noted for Example 8, persisted for this polymer. This was found to be the case, see FIG. 4.

When assessed in a fully formulated oil screener, it performed perfectly well when compared to conventional succinimide dispersants. Further, while conventional succinimide dispersants have acceptable soot dispersancy in low polar base stocks, such as Type A and synthetic base stock—it has been found that the copolymers of the invention have significant treat rate advantages combined with non-engine performance bonuses.

Figure 5:
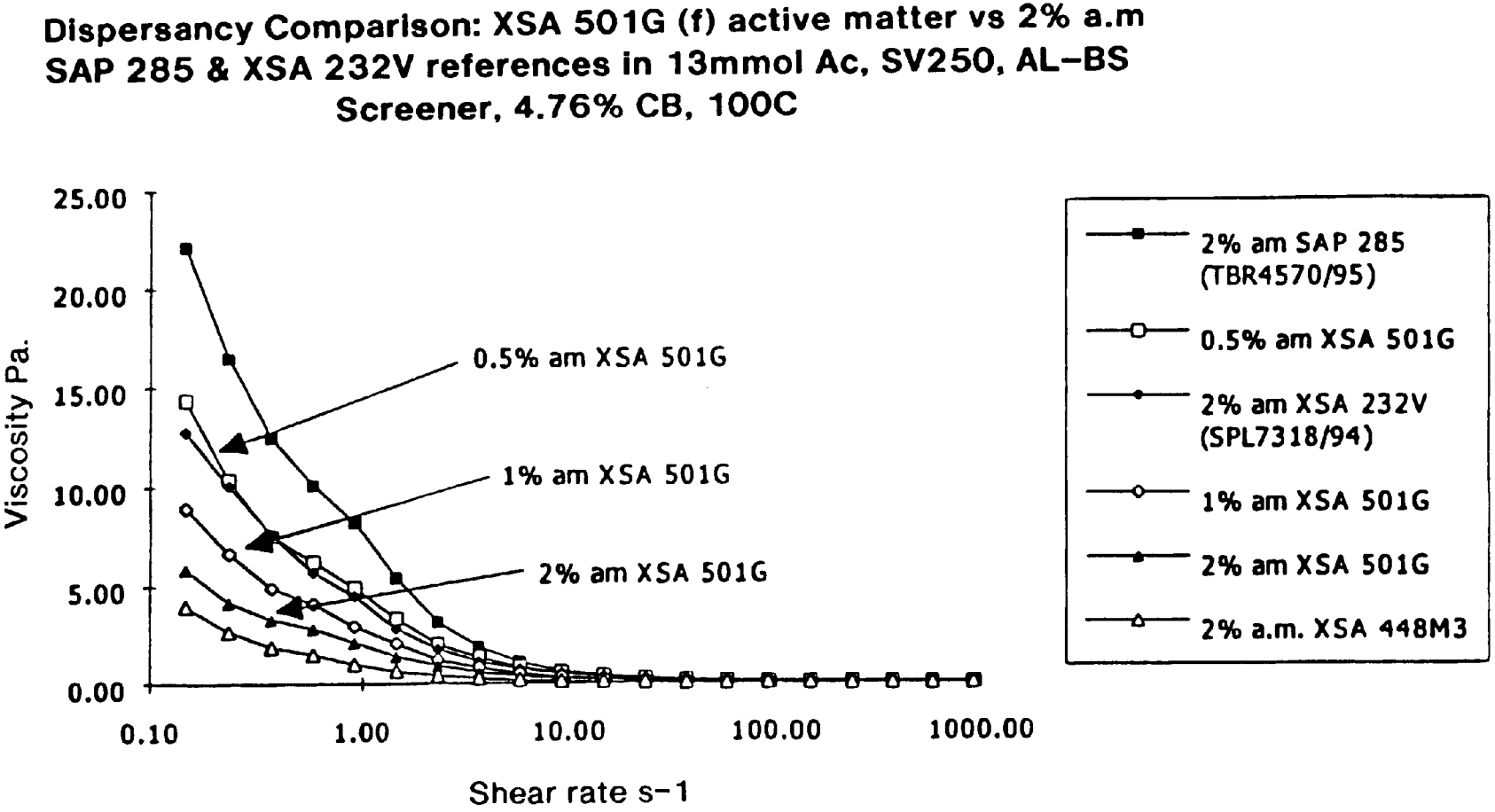
FIG. 5 illustrates a comparison of the dispersing properties of diblock copolymers of Examples 7 and various reference dispersants in a base oil.

Comparative data are shown in FIG. 5 ranking Example 7 against succinimide and post-treated succinimide dispersants, where it is seen that at 0.5% am. of Example 7, a dispersancy response is seen which is equivalent to 2.0% active matter of Reference 2 (a high nitrogen content succinimide dispersant) in a detergent inhibitor containing screener formulation.

As an example of a filly blended product, it was found possible to blend a 15W40 fully formulated oil containing a shear stable VII with 1% active matter of Example 7 and 6% polybutenyl succinimide (molecular weight range of polybutene 1500–2500) and other D1 components with no viscometnc problems.

It has been demonstrated in principle that is possible to obtain carbon black soot dispersancy from low molecular weight analogues of diblock copolymers. It has been surprisingly demonstrated that a critical chain length of poly (monovinyl aromatic hydrocarbon) is required to achieve adsorption/stability and that dispersancy is surprisingly not compromised by overly compact micelle formation.

The isoprene/styrene diblocks dispersants show significantly lower corrosion activity (Table 1) than succinimide dispersants in the Cummins L10 bench corrosion test.

Figure 7:
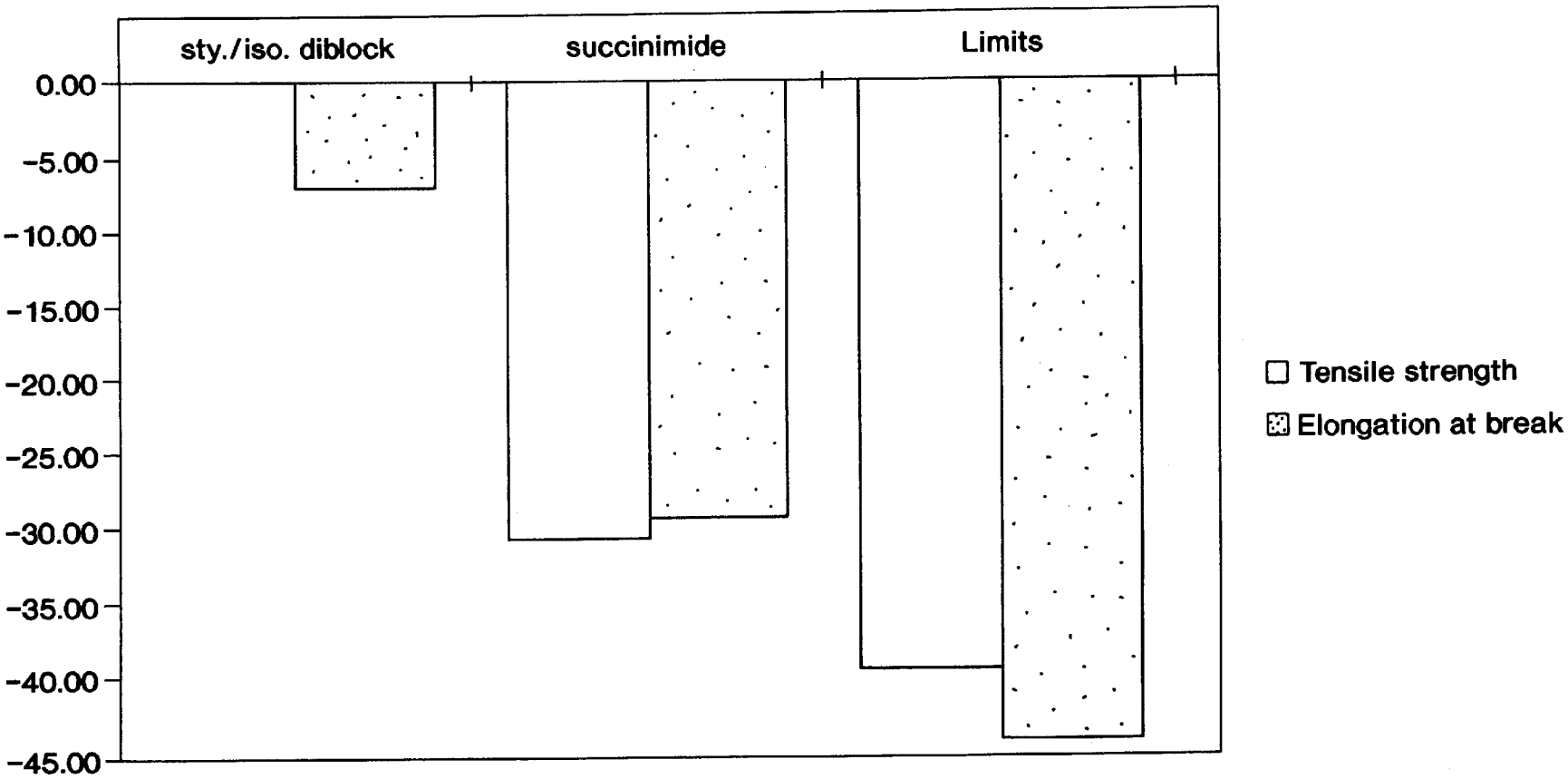
FIG. 7 compares the seal compatibility of a styrene/isoprene block copolymer that of a succinimide dispersant.

The isoprenelstyrene diblocks do not degrade engine elastomer seals to the same extent as succinimide dispersants (Table 2 and FIG. 7).

Figure 6:
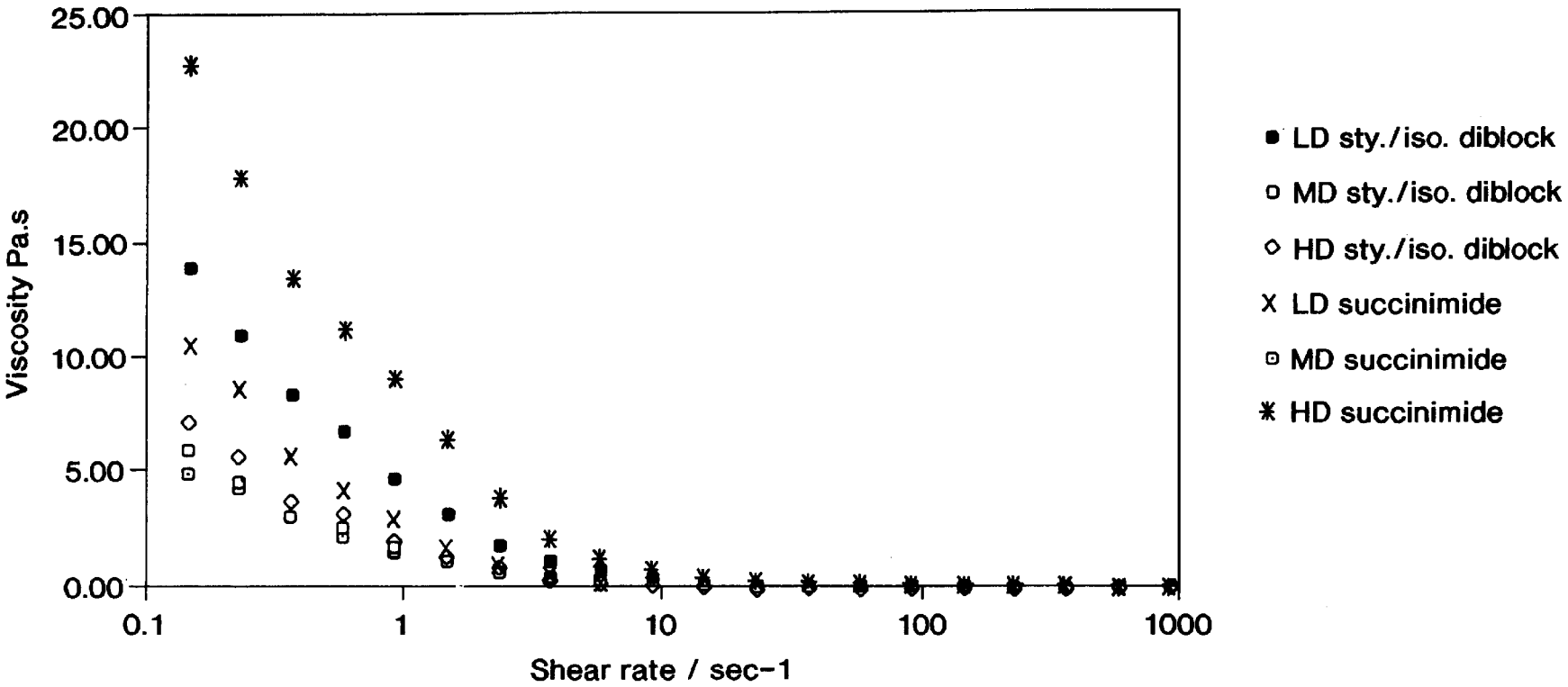
FIG. 6 plots the dispersancy performance of a diblock copolymer of Example 7, and a succinimide in a base oil containing an overbased detergent soap.

FIG. 6 shows a comparison of dispersancy performance in various levels of over based detergent levels and the results clearly show that the dispersancy of diblock dispersants does not suffer in the presence of over-based detergent to same extent as succinimide dispersants.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

TABLE 1

| | | Corrosion data | | |
|---|---|---|---|---|
| | | Cummins L-10 bench corrosion test data | | |
| Dispersant | % active matter | tin corrosion/ ppm | lead corrosion/ppm | copper corrosion/ppm |
| succinimide | 0.9 | <1 | 10 | 4 |
| succinimide | 1.35 | <1 | 17 | 5 |
| succinimide | 1.8 | <1 | 29 | 6 |
| diblock (sty/iso) | 1.25 | <1 | 2 | 3 |

TABLE 2

| Elastomer seals data Lab method VDA 521-01 Daimler Benz with Fluoro elastomer seals (Modified) AK6 Parker rubbers | | | | | | | | |
|---|---|---|---|---|---|---|---|---|
| Blend | | Tensile Strength % Delta | | Mean mean | Elongation % Delta | | Mean | mean |
| No. | Description | mean | median | median | mean | median | mean | P/F |
| 1 | 1.25% Example & in fully formulated oil Type B | 0.34 | 0.07 | 0.07 | −4.3 | −5.6 | −4.30 | Borderline PASS |
| 2 | 2.5% Example & in fully formulated oil Type B | −0.20 | −2.47 | −2.47 | −4.5 | −6.6 | −4.50 | PASS |
| 3 | 1.25% Example 7 2% am succinimide dispersant in fully formulated oil Type B | −13.78 | −14.93 | −14.93 | −19.4 | −20.7 | −19.39 | PASS |
| 4 | 1.25% Example 7 2.5% am succinimide dispersant in fully formulated oil Type B | −20.34 | −21.00 | −21.00 | −25.7 | −26.7 | −25.70 | PASS |
| 5 | 1.25% Example 7 3% am succinimide dispersant in fully formulated oil Type B | −25.61 | −26.93 | −26.93 | −29.2 | −30.4 | −29.20 | PASS |

What is claimed is:

1. A lubricating oil composition comprising a di-block copolymer of poly(monovinyl aromatic hydrocarbon) and hydrogenated poly(conjugated diene) as a dispersant additive, said di-block copolymer comprising poly (monovinyl aromatic hydrocarbon) in the molecular weight range 8,000–30,000, wherein the poly(monovinyl aromatic hydrocarbon): hydrogenated poly(conjugated diene) molecular weight ratio is in the range of 3:2 to 10:1.

2. A lubricating oil composition according to claim 1, wherein the molecular weight range of the poly(monovinyl aromatic hydrocarbon) is in the range 8,400–25,000.

3. A lubricating oil composition according to claim 1 wherein the percentage of poly(monovinyl aromatic hydrocarbon) in the poly(monovinyl aromatic hydrocarbon) /hydrogenated poly(conjugated diene) di-block copolymer is at least 60% w/w.

4. A lubricating oil composition according to claim 1 wherein the block copolymers are selected from the group consisting of those of the formulae $A_n(BA)_m$, wherein A represents a block polymer of predominantly poly (monovinyl aromatic hydrocarbon), wherein B represents a block of predominantly poly(conjugated diene), wherein m represents an integer ≧1, and n represents 0 or 1.

5. A lubricating oil composition according to claim 1, wherein the monovinyl aromatic hydrocarbon used to prepare the poly(monovinyl aromatic hydrocarbon) block of said di-block copolymer is selected from styrene, alkyl-substituted styrene and alkoxy substituted styrene.

6. A lubricating oil composition according to claim 1, wherein the poly(conjugated diene) block of said di-block copolymer is a conjugated diene containing from 4 to 24 carbon atoms.

7. A lubricating oil composition according to claim 1 wherein the poly(conjugated diene) is hydrogenated.

8. A lubricating oil Composition according to claim 1 wherein the poly(monovinyl aromatic hydrocarbon) is polystyrene.

9. A lubricating oil composition according to claim 1 wherein the poly(conjugated diene) is hydrogenated polyisoprene.

10. A dispersant for a lubricant oil composition comprising a di-block copolymer in accordance with claim 1.

11. An additive package for a lubricant oil composition comprising a di-block copolymer in accordance with claim 1.

12. A lubricating oil composition according to claim 1, wherein the percentage of poly(monovinyl aromatic hydrocarbon) in the poly(monovinyl aromatic hydrocarbon)/ hydrogenated poly(conjugated diene) di-block copolymer is at least 60% w/w.

13. A lubricating oil composition according to claim 1, wherein the block copolymers are selected from the group consisting of those of the formulae $A_n(BA)_m$, wherein A represents a block polymer of predominantly poly (monovinyl aromatic hydrocarbon), wherein B represents a block of predominantly poly(conjugated diene), wherein m represents an integer≧1, and n represents 0 or 1.

14. A lubricating oil composition according to claim 1, wherein the monovinyl aromatic hydrocarbon used to prepare the poly(monovinyl aromatic hydrocarbon) block of said di-block is selected from styrene, alkyl-substituted styrene and alkoxy substituted styrene.

15. A lubricating oil composition according to claim 1, wherein the poly(conjugated diene) block of said di-block copolymer is a conjugated diene containing from 4 to 24 carbon atoms.

16. A lubricating oil composition according to claim 1, wherein the poly(conjugated diene) is hydrogenated.

17. A lubricating oil composition according to claim 1, wherein the poly(monovinyl aromatic hydrocarbon) is styrene.

18. A lubricating oil composition according to claim 1, wherein the poly(conjugated diene) is hydrogenated polyisoprene.

19. A dispersant for a lubricant oil composition comprising a di-block copolymer in accordance with claim 1.

20. An additive package for a lubricant oil composition comprising a di-block copolymer in accordance with claim 1.

* * * * *